US008096905B1

(12) United States Patent
Gillig

(10) Patent No.: US 8,096,905 B1
(45) Date of Patent: Jan. 17, 2012

(54) ARCHERY BROADHEAD WITH REPLACEABLE BLADES

(75) Inventor: Jason M. Gillig, Neenah, WI (US)

(73) Assignee: Tru-Fire Corporation, North Fond Du Lac, WI (US)

( * ) Notice: Subject to any disclaimer, the term of this patent is extended or adjusted under 35 U.S.C. 154(b) by 118 days.

(21) Appl. No.: 12/704,905

(22) Filed: Feb. 12, 2010

Related U.S. Application Data

(60) Provisional application No. 61/152,816, filed on Feb. 16, 2009.

(51) Int. Cl.
*F42B 6/08* (2006.01)

(52) U.S. Cl. ..... 473/584

(58) Field of Classification Search ..... 473/583, 473/584
See application file for complete search history.

(56) References Cited

U.S. PATENT DOCUMENTS 4,210,330 A * 7/1980 Kosbab ..... 473/584
5,145,186 A * 9/1992 Maleski ..... 473/584
5,417,440 A * 5/1995 Barrie et al. ..... 473/584
5,482,293 A * 1/1996 Lekavich ..... 473/584
6,077,180 A * 6/2000 Adams, Jr. ..... 473/584
7,011,589 B2 3/2006 Davis
7,708,659 B2 * 5/2010 Grace, Jr. ..... 473/584

OTHER PUBLICATIONS

Bass Pro Shops Archery 2002 Specialists Catalog,: Titanium Broadheads (p. 30).
Cabela's® 2008 Edition Archery catalog: Wac'Em Triton Brodheads (p. 64).
Cabela's® 2008 Edition Archery catalog: Titanium Broadheads (p. 69).
Kinsey's, 2009-10 Master Catalog: Sullivan Innerloc Falcon Stainless Broadheads (p. 94).

* cited by examiner

*Primary Examiner* — John Ricci
(74) *Attorney, Agent, or Firm* — Craig A. Fieschko, Esq.; DeWitt Ross & Stevens S.C.

(57) ABSTRACT

A broadhead with removable and replaceable blades has a forward body end which receives the forward ends of the blades, and the rear ends of the blades are then engaged to the rear body end by a spring or other retaining member which can be moved to engage or disengage the rear blade ends. The broadhead can then receive an arrow shaft, with the arrow shaft fitting over and encasing the retaining member and preventing its accidental (or otherwise undesirable) release of the blades.

36 Claims, 4 Drawing Sheets

ARCHERY BROADHEAD WITH REPLACEABLE BLADES

CROSS-REFERENCE TO RELATED APPLICATIONS

This application claims priority under 35 USC §119(e) to U.S. Provisional Patent Application 61/152,816 filed Feb. 16, 2009, the entirety of which is incorporated by reference herein.

FIELD OF THE INVENTION

This document concerns an invention relating generally to arrowheads used in archery, and more specifically to broadhead-type arrowheads wherein one or more blades extend outwardly from the body of the arrowhead.

BACKGROUND OF THE INVENTION

In order to maximize trauma to game animals, and thereby kill them more quickly and humanely, bowhunters often hunt game animals with broadhead-type arrowheads, that is, arrowheads which bear one or more blades extending laterally outwardly from the arrowhead and its trailing arrow shaft. This is in contrast to arrowheads used for recreational archery, which generally have a simple conical/pointed shape with no laterally-extending protrusions. The objective of a broadhead is to increase the effective area of the arrowhead which strikes the target animal, thereby enhancing the size of the inflicted wound and the lethality of the arrow.

Over time, blades may grow dull or bend. Sharpening and/or unbending a blade is not recommended, since irregularities in the weight and/or shape of blades may cause an arrow to veer from its intended path. Replacement of blades is therefore the preferred remedy, though not all broadheads allow removal and replacement of blades, and those that do allow blade replacement tend to suffer from several drawbacks. The blades must be strongly held in the broadhead to avoid falling off when a target is struck, but at the same time they must be easily removed—and these goals often compete with each other. It is undesirable to require tools or great force to remove a blade from a broadhead, since it is inconvenient to require use of tools (particularly when replacing blades in the field, where a bowhunter may not have tools at hand), and the chances of cutting oneself when changing blades is much higher if one must "struggle" with a blade to remove it. Often, blades are easily removable from a broadhead once the broadhead is removed from an arrow shaft, but broadheads of this type tend to suffer from the problem that the blades are too loosely held by the broadhead—or are not held at all—upon removal of the shaft. As a result, blades can readily fall out of a broadhead upon its removal from (or attempted installation on) a shaft, and the blades are then difficult to find, particularly in the field where fallen blades may be hidden by grass or other ground features. Many broadheads with removable blades also require disassembly into multiple small parts to remove and replace blades, which can also be problematic owing to the ease with which parts can be dropped and lost (again, particularly in the field).

SUMMARY OF THE INVENTION

The invention, which is defined by the claims set forth at the end of this document, involves an arrowhead (broadhead) which at least partially addresses the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Looking initially to FIG. 6 for a view of a preferred version of the arrowhead 100 in assembled form (with the arrowhead 100 generally being denoted by the reference numeral 100), and to FIG. 1 for a view in disassembled form, the arrowhead 100 includes one or more (and preferably two to four) blades 102; an elongated body 104 onto which the blades 102 are mounted; and optionally an arrow shaft 200 (only partially shown, and which might be provided with the body 104 and blades 102, or which might be provided separately). Each of these parts will now be discussed in turn.

Looking to FIG. 1, each blade 102 has an inner blade edge 106 and an opposing outer blade edge 108 (which is preferably sharpened), with the inner and outer blade edges 106 and 108 extending between opposing forward and rear blade ends 110 and 112. The forward blade end 110 preferably includes a protruding inner tongue 114 at or adjacent the inner blade edge 106; a protruding outer tongue 116 at or adjacent the outer blade edge 108; and a mouth 118 defined between the inner tongue 114 and the outer tongue 116. As will be discussed below, these structures can allow the forward blade end 110 to be firmly affixed to the arrowhead body 104. The rear blade end 112 then preferably includes a protruding tail 120 at or near the inner blade edge 106, and an indent 122 situated between the tail 120 and the outer blade edge 108 (and preferably being situated immediately adjacent the tail 120), with these structures similarly allowing connection of the rear blade end 112 to the arrowhead body 104 (as will be discussed in greater detail below).

The body 104 then includes a forward body portion 124 along which a major portion of each blade 102 extends, and a rearward body portion 126 to which the arrow shaft 200 may be affixed (see FIG. 6). The forward body portion 124 extends rearwardly from a forward body portion tip end 128 to a forward body portion rear end 130, with the forward body portion tip end 128 preferably including structure allowing attachment of the forward blade end 110. An exemplary arrangement for such attachment includes a tip slot 132 (see FIG. 1) extending in a direction along the length of the body 104, and a socket 134 situated radially closer to the lengthwise axis of the body 104 than the tip slot 132, and extending forwardly in a direction along the length of the body 104 such that the socket 134 defines a space between the tip end 128 and a portion of the forward body portion 124 extending rearwardly from the tip end 128. The tip slot 132 and socket 134 cooperate with the aforementioned outer tongue 116, mouth 118, and inner tongue 114 of the forward blade end 110, with the tip slot 132 receiving the outer tongue 116 and the socket 134 receiving the inner tongue 114. The tip slot 132 helps restrain the forward blade end 110 against displacement in directions oriented circumferentially about the forward blade end 110, and the socket 134 helps restrain the forward blade end 110 against displacement away from the forward blade end 110 in a direction radially away from the lengthwise axis of the body 104, and also in a direction toward the tip end 128 along the length of the body 104. Preferably, the forward body portion 124 also includes a blade pocket 136 which extends rearwardly away from each tip slot 132 and socket 134 for receiving the inner blade edge 106 of a blade 102.

The rearward body portion 126 preferably includes a rearward body portion first section 138 extending rearwardly from the forward body portion rear end 130, wherein the rearward body portion first section 138 has lesser outer diameter than the forward body portion rear end 130; a rearward body portion second section 140 extending rearwardly from the rearward body portion first section 138, wherein the rearward body portion second section 140 has lesser outer diameter than the rearward body portion first section 138; and a rearward body portion third section 142 extending rearwardly from the rearward body portion second section 140, wherein the rearward body portion third section 142 preferably has an outer diameter which is threaded, and which is preferably sized with an outer diameter equal to or less than the outer diameter of the rearward body portion second section 140. The blade pocket 136 extends along at least the first and second sections 138 and 140 of the rearward body portion 126, into which the rear blade end 112 may be inserted (as seen in FIGS. 2-6).

A retaining member 144—which is preferably provided in the form of a spring—is closely and movably fit over the second section 140 of the rearward body portion 126 such that when the rear blade end 112 is inserted within the blade pocket 136 at the rearward body portion second section 140, the retaining member 144 may be moved forwardly over the blade pocket 136 and the rear blade end 112 therein to secure the rear blade end 112 to the rearward body portion 126. This is shown in FIGS. 2-6, which sequentially illustrate the insertion of the rear blade end 112 (more particularly its tail 120) within a blade pocket 136 (not visible in FIGS. 2-6) and beneath the spring 144, with the spring 144 deflecting rearwardly (FIGS. 2-4) to accommodate rearward movement of the blade 102 to position the outer tongue 116 of the forward blade end 110 within the tip slot 132 and the inner tongue 114 within the socket 134. The spring 144 has a forward spring end 146 in abutment with the first section 138 of the rearward body portion 126, and a rearward spring end 148 in abutment with a collar-like stop 150 fit over the second section 140 of the rearward body portion 126. The stop 150, if provided in the form of a collar, is preferably crimped about, welded to, or otherwise affixed about the rearward body portion second section 140 such that the spring 144 is sandwiched in compression between the stop 150 and the rearward body portion second section 140. The spring 144 is therefore biased forwardly toward the forward body portion 124. As a result, as particularly seen in FIGS. 4-5, when the blade 102 is released, the spring 144 urges the tail 120 of the blade 102 forwardly so that the forward blade end 110 is engaged with the forward body portion tip end 128.

As seen in FIG. 6, an exemplary arrow shaft 200 (shown bisected along its axis)—which has an internally threaded female socket, as is common for archery shafts 200—may then be fit over the stop 150 and the spring 144, and affixed to the threaded rearward body portion third section 142, to abut the forward body portion 124. More preferably, the forward end of the shaft 200 abuts a washer 152 fit over the rearward body portion first section 138 to rest adjacent the forward body portion 124 within the indent 122 of the rear blade end 112. The arrow shaft 200 therefore encases the spring 144, and also urges against the washer 152, to prevent deflection of the spring 144 and release of the rear blade end 112. The arrow shaft 200 preferably closely surrounds the outer diameters of the rearward body portion first section 138, the spring 144, and the stop 150, all of which are preferably at least substantially equivalent in their outer diameters. The washer 152 has an inner diameter sized to fit over the stop 150, the spring 144, and the rearward body portion first section 138, allowing its installation forwardly of the arrow shaft 200 as seen in FIGS. 5-6.

Owing to the foregoing arrangements, the arrowhead 100 has easily removable and replaceable blades 102 once the body 104 is removed from the arrow shaft 200, and the blades 102 are deterred from readily falling out of the body 104 upon such removal. Blades 102 can be installed by following the steps shown in FIGS. 2-6, and can be removed by reversing these steps.

Further advantages, features, and objects of the invention will be apparent from the remainder of this document in conjunction with the associated drawings.

BRIEF DESCRIPTION OF THE DRAWINGS

FIGS. 2-6 illustrate a process by which a blade 102 may be installed in the arrowhead 100, wherein:

FIG. 2 shows the tail 120 of the blade 102 being inserted rearwardly into a blade pocket 136 (not visible in FIGS. 2-6);

FIG. 3 shows the rearward deflection of the spring 144 toward the stop 150 as the tail 120 of the blade 102 continues its rearward insertion into the blade pocket 136, with the tail 120 beginning to fit beneath the spring 144;

FIG. 4 shows the tail 120 fully inserted within the blade pocket 136 with the spring 144 urged forwardly over the tail 120, and with the inner blade edge 106 fully resting within the blade pocket 136;

FIG. 5 shows the blade 102 moved forwardly so that the tip slot 132 (not visible) of the tip end 128 of the forward body portion 124 receives the outer tongue 116, and the socket 134 receives the inner tongue 114, with the spring 144 urged forwardly over the tail 120 (not visible) to abut the first section 138 of the rearward body portion 126;

FIG. 6 then shows installation of the optional washer 152, which fits within the indent 122 of the rear blade end 112 and further restrains the tail 120 (not visible) of the rear blade end 112 within the blade pocket 136, and installation of the arrow shaft 200 (shown partially, and bisected along its axis), which encloses the tail 120, the spring 144, the stop 150, and the second and third sections 142 of the rearward body portion 126 (and a major portion of the first section 138) to further secure the blade 102 in the arrowhead 100 (with the shaft 200 engaging the threading of the third section 142).

DETAILED DESCRIPTION OF PREFERRED VERSIONS OF THE INVENTION

Figure 1:
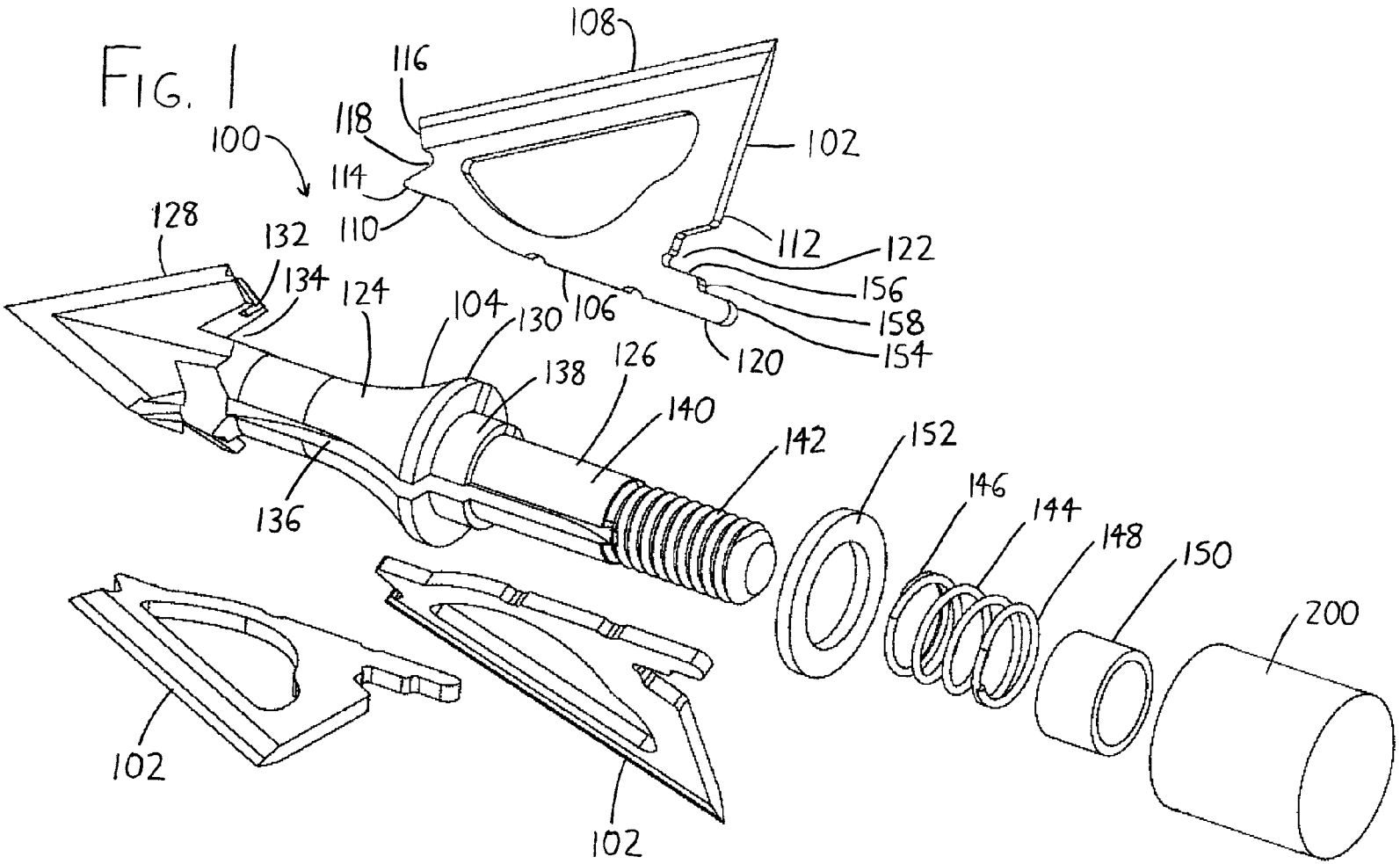
FIG. 1 is an exploded (disassembled) view of an exemplary preferred version of the invention, showing the blades 102 and the retaining member 144 (spring 144), stop 150, and washer 152 removed from the body 104 of the arrowhead 100.
Figure 2:
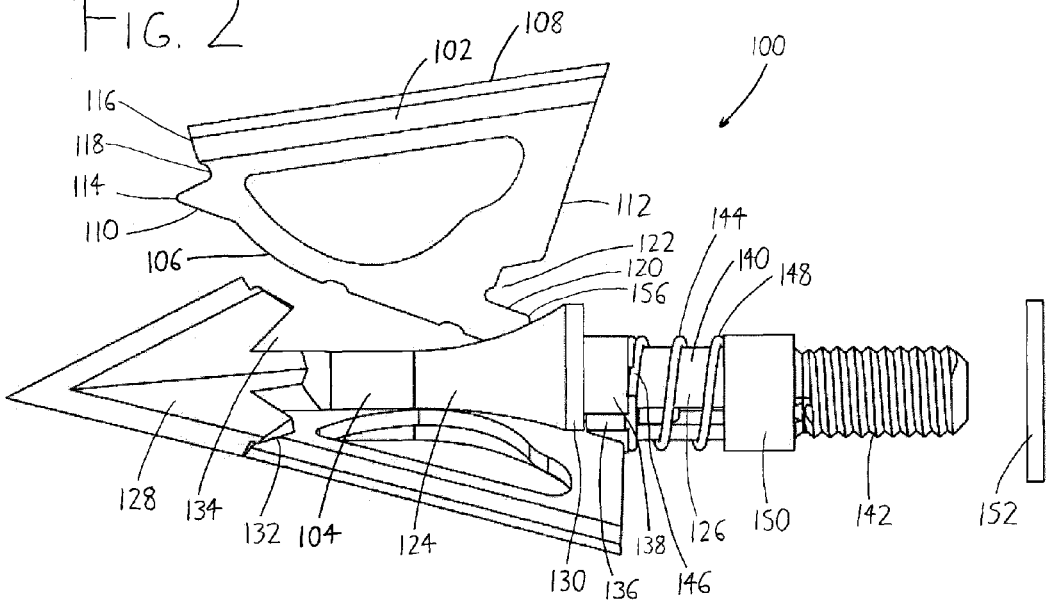
Figure 3:
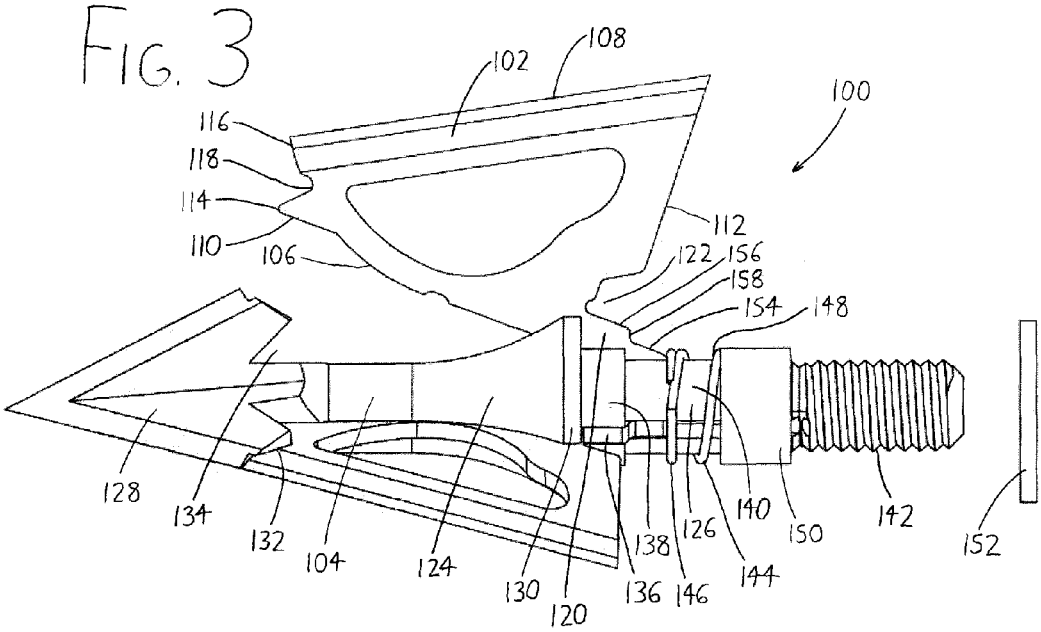
Figure 4:
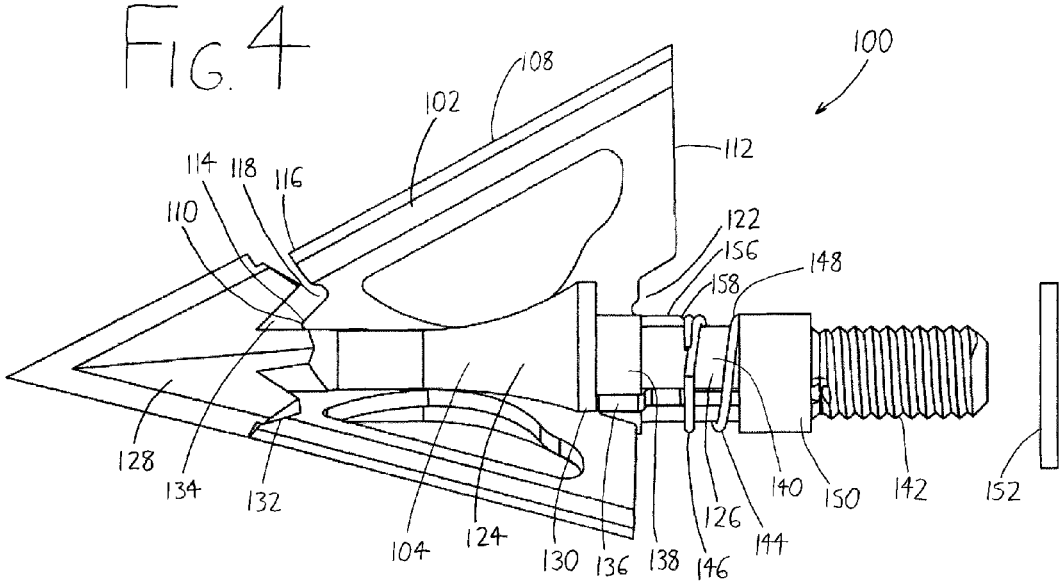
Figure 5:
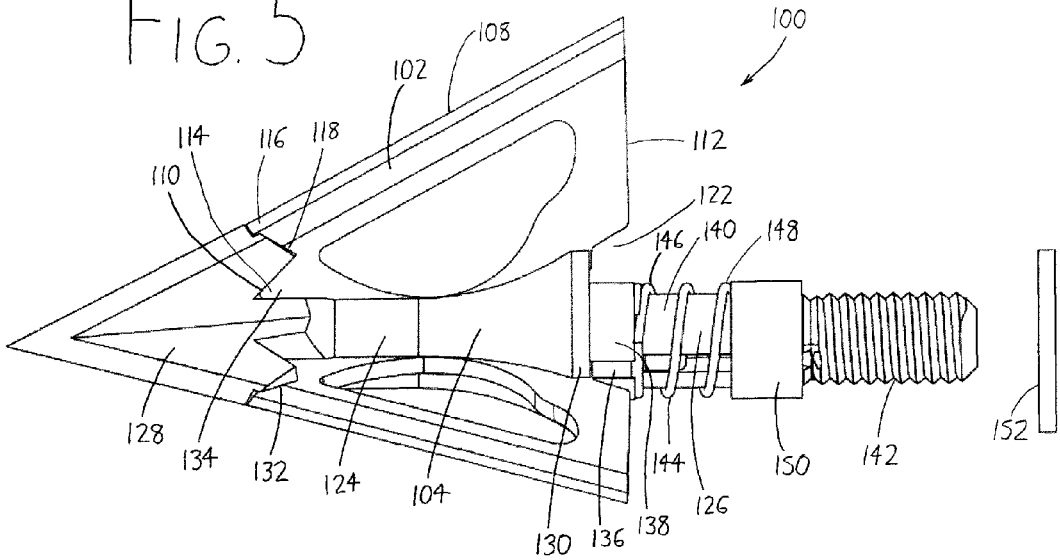
Figure 6:
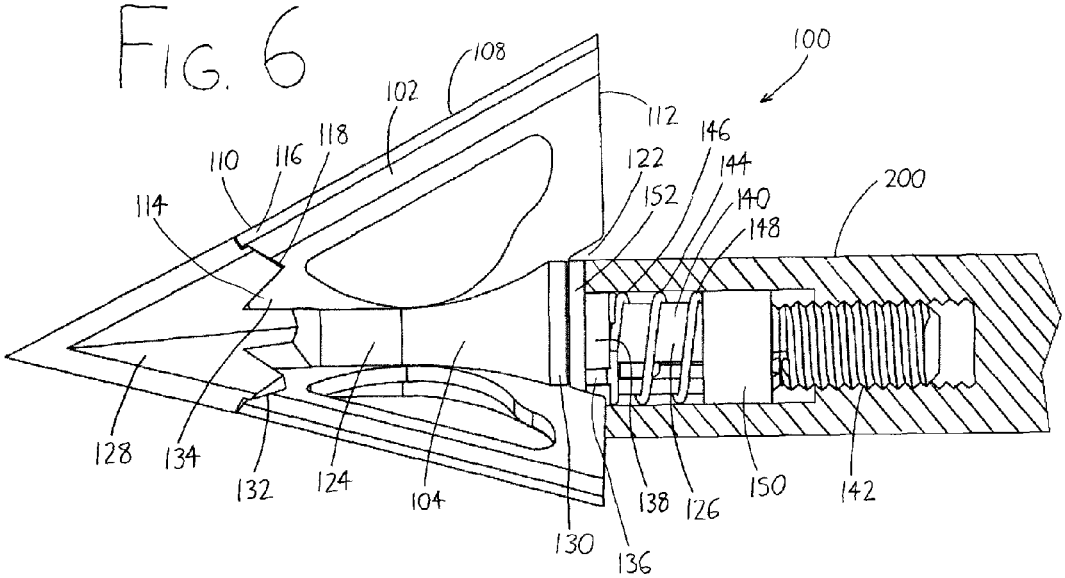

Expanding on the discussion above, FIG. 1 shows a preferred configuration for the tail 120 of the rear blade end 112, wherein the tail 120 includes a rear tail portion 154 which is sized to have an outer diameter (as measured with respect to the axis of the arrowhead body 104 after installation on the body 104) which closely conforms to the outer diameter of the second section 140 of the rearward body portion 126. The tail 120 also includes a forward tail portion 156 which is sized to have an outer diameter which closely conforms to the outer diameter of the first section 138 of the rearward body portion 126. As a result, an urging surface 158 is defined between the rear tail portion 154 and the forward tail portion 156 against which the spring 144 may press (see FIGS. 5-6, wherein the urging surface 158 is only visible in FIG. 5), with the spring 144 fitting over only the rear tail portion 154. While this urging surface 158 is optional—the tail 120 may simply be configured overall similarly to the rear tail portion 154, for example—it is useful because it assists in urging the blade 102 forwardly to fix the forward blade end 110 into the tip slot 132 and socket 134 of the forward body portion tip end 128. If desired, the relative proportions of the forward and rear tail portions 156 and 154 may be modified, particularly to increase the length of the forward tail portion 156 and reduce the length of the rear tail portion 154. If this is done, the rear tail portion 154 is still fit within the spring 144 and the forward blade end 110 is still urged into engagement with the tip end 128 of the forward body portion 124, but the spring 144 remains in greater compression after the blade 102 is installed because the forward end of the spring 144 is not in abutment with the first section 138 of the rearward body portion 126 (as in FIG. 5). This can be useful if manufacturing tolerances are such that replacement blades 102 might not be fully sandwiched between the spring 144 and the tip end 128 of the forward body portion 124 when in the state shown in FIG. 5, i.e., if the urging surface 158 rests slightly forwardly of the juncture between the first and second sections 138 and 140 of the rearward body portion 126. If this occurs, the blade 102 may be free to effect a (very small) amount of forward/rearward translation within its blade pocket 136 after installation is complete.

The washer 152—if one is used—is the only part that can readily separate from the arrowhead 100 and be lost when the arrowhead 100 is removed from the arrow shaft 200. This can be deterred if the washer 152 is formed so it very closely fits about the first section 138 of the rearward body portion 126, the spring 144, and the stop 150. If the washer 152 is formed of an elastomer or the like, it may even be sized such that it is force-fit about these components, and thereby resists falling from the rearward body portion 126. In any event, the washer 152 tends to resist easily slipping rearwardly on the spring 144 (at least where a coil spring 144 is used), and thus tends to resist loss. However, if a washer 152 is used, loss can be entirely prevented if the broadhead is never fully removed from the arrow shaft 200, and is only partially unscrewed or otherwise withdrawn from the arrow shaft 200 to the extent needed to exchange blades 102.

As best seen in FIG. 1, the blade pockets 136 are preferably formed as slots whose widths very closely match the thicknesses of the blades 102. As a result, the blades 102 may be frictionally retained within the blade pockets 136 when the forward spring end 146 is moved rearwardly to free the blade tails 120.

It is emphasized that the preferred version of the invention discussed above (and shown in the drawings) is merely an exemplary one, and the invention can be modified in many ways, and can have a substantially different appearance. Following are examples of possible modifications.

Initially, the body 104 can be differently shaped. As an example, it need not have an enlarged tip end 128, and it might simply take a rod-like form with a sharpened tip, in which case slots could be undercut near the tip end 128 to define sockets wherein the forward blade ends 110 can be retained. The body 104 need not be formed as a single piece (though this is preferable), and could (for example) have removable/interchangeable tip ends 128 or other features. The stop 150 could be provided in different forms, e.g., it might simply be defined as threading on the body portion third section 142 which has a diameter greater than the outer diameter of the rearward body portion second section 140. (Or such threading may even have a diameter less than the outer diameter of the rearward body portion second section 140, with the spring engaging the stop formed by the threading by winding between the threading.)

The retaining member 144 used to releasably retain the rear blade end 112 to the rearward body portion 126 has generally been described as a spring 144, but it could take other forms. As one example, it could take the form of a movable collar replacing the stop 150, wherein the movable collar is not affixed to the second section 140 of the rearward body portion 126 and is instead translatably situated thereon. Such a movable collar could also be elongated to extend along all (or at least a more substantial part) of the rearward body portion second section 140. The movable collar could then just be manually slid rearwardly to free the rear blade ends 112, and manually slid forwardly to restrain them. As another alternative, the retaining member 144 might take the form of an elastomeric ring, e.g., a rubber O-ring, which can be stretched to fit it about the rearward body portion 126, and which can be "rolled" or otherwise moved along the rearward body portion 126 as desired.

Where the retaining member 144 is provided in the form of a spring, the spring 144 need not take a helical form, and could take the form of other elastically compressible members. As examples, the spring 144 could instead take the form of an elastomeric tube; one or more Belleville springs (i.e., one or more elastically compressible conical or cup-shaped washers); wave springs (i.e., springs formed of a stack of undulating rings, wherein the peaks of one ring are attached to the valleys of an adjacent ring); or any other appropriate springs.

The stop 150 need not be formed as a collar joined to the second section 140 of the rearward body portion 126, and might instead be formed as one or more pins inserted into the second section 140, or might be molded about or otherwise formed on the second section 140.

The blades 102 can also assume a wide variety of different shapes, with different shapes/contours along their outer blade edges 108 and/or inner blade edges 106, and having solid/continuous surfaces rather than having cut-out portions along their areas. The blade pockets 136 need not be slot-like in form, and can assume whatever configuration may be useful to complementarily receive one or more portions of the inner blade edges 106. Note that the inner blade edges 106 and the floors of the blade pockets 136 within the body 104 might have complementary interfitting structure to further deter displacement of the blades 102 along the axis of the body 104, e.g., the small notches shown along the inner blade edges 106 (FIG. 1) might receive protrusions raised above the floors of the blade pockets 136.

The blade 102 and body 104 might engage each other in different ways, e.g., rather than the forward blade end 110 being fit within a socket 134 in the tip end 128 of the body 104, the forward blade end 110 might bear a socket into which a portion of the tip end 128 of the body 104 might protrude. (Such an arrangement is actually already present since a section of the tip end 128 between the slot 132 and socket 134 is received within the mouth 118 of the forward blade end 110, but other arrangements of this nature are possible.) As another example, the tail 120 at the rear blade end 112 need not be present, or need not be as large as the one depicted in the drawings. As yet another example, the large indent 122 shown in the rear blade end 112 adjacent the tail 120 could be shrunken to a size just large enough to fit the forward spring end 146 therein, such that the tail 120 and the remainder of the rear blade end 112 rest closely adjacent to each other, and extend by the same distance from the blade 102, being separated by the indent 122.

Also regarding the blades 102, throughout much of this document (and in the claims below), where the term "blade end" is used (as in "forward blade end" and "rear blade end"), this generally refers to the ends of the blade 102 at the inner blade edge 106. Thus, it should be understood that the overall/gross length of the blade 102 is not necessarily delimited by the "blade ends," e.g., portions of the blade 102 at the outer blade edge 108 might extend beyond the "blade ends."

The arrow shaft 200 can affix to the arrowhead 100 in ways other than that shown in the drawings. For example, an arrow shaft 200 might have a threaded male forward end that screws into a threaded female socket at the trailing end of the body 104. Attachments apart from threading may be used, e.g., interference fits, spring-loaded or elastically-loaded interlocks (similar to those found on tent poles and the like, where a spring-loaded button on one member extends into an aperture on another member), or other attachments.

Other modifications are possible as well. Since the versions of the invention described above are merely exemplary, the invention is not limited to these versions, and instead the scope of rights to the invention is limited only by the claims set out below. The invention encompasses all different versions that fall literally or equivalently within the scope of these claims.

What is claimed is:

1. An arrowhead including:

a. a blade extending between opposing forward and rear blade ends, b. an elongated body including (1) a forward body portion extending rearwardly from a tip end to a rear end, wherein the forward blade end is interfit with the forward body portion such that it is restrained against displacement away from the body:

(a) in a direction radially away from the lengthwise axis of the body, and (b) in a direction toward the tip end along the length of the body;

(2) a rearward body portion including:

(a) a first section extending rearwardly from the rear end of the forward body portion, wherein the first section has lesser outer diameter than the rear end of the forward body portion;

(b) a second section extending rearwardly from the first section of the rearward body portion, wherein the second section has lesser outer diameter than the first section of the rearward body portion;

(c) a blade pocket defined in the first and second sections, wherein the rear blade end rests within the blade pocket;

c. a retaining member closely fit over at least a portion of the second section of the rearward body portion, the retaining member being fit over the blade pocket and the rear blade end therein, wherein the retaining member includes a spring extending between:

(1) a forward spring end situated rearwardly of the first section of the rearward body portion, and (2) a rearward spring end.

2. The arrowhead of claim 1 further including a stop:

a. protruding from at least a portion of the second section of the rearward body portion, and b. extending rearwardly from the rearward spring end.

3. The arrowhead of claim 2 further including an arrow shaft fit over:

a. the retaining member, and b. the stop.

4. The arrowhead of claim 1 wherein the rearward body portion further includes a third section:

a. extending rearwardly from the second section of the rearward body portion, b. bearing threading thereon, and c. having an outer diameter less than or equal to the outer diameter of the second section of the rearward body portion.

5. The arrowhead of claim 1 further including a washer closely fit over at least a portion of the first section of the rearward body portion, the washer being fit over the blade pocket and the rear blade end therein.

6. The arrowhead of claim 5 further including an arrow shaft:

a. fit over the retaining member, and b. in abutment with the washer.

7. An arrowhead including:

a. a blade extending between opposing forward and rear blade ends, b. an elongated body including (1) a forward body portion extending rearwardly from a tip end to a rear end, wherein the forward blade end is interfit with the forward body portion such that it is restrained against displacement away from the body:

(a) in a direction radially away from the lengthwise axis of the body, and (b) in a direction toward the tip end along the length of the body;

(2) a rearward body portion including:

(a) a first section extending rearwardly from the rear end of the forward body portion, wherein the first section has lesser outer diameter than the rear end of the forward body portion;

(b) a second section extending rearwardly from the first section of the rearward body portion, wherein the second section has lesser outer diameter than the first section of the rearward body portion;

(c) a blade pocket defined in the first and second sections, wherein the rear blade end rests within the blade pocket;

c. a retaining member closely fit over at least a portion of the second section of the rearward body portion, the retaining member being fit over the blade pocket and the rear blade end therein, wherein the retaining member and the first section of the rearward body portion have outer diameters which are at least substantially equivalent.

8. The arrowhead of claim 7 wherein retaining member includes a spring biased forwardly toward the forward body portion.

9. The arrowhead of claim 7 wherein the tip end of the forward body portion includes:

a. a tip slot extending in a direction along the length of the body; and b. a socket situated radially closer to the lengthwise axis of the body than the tip slot, the socket extending in a direction along the length of the body.

10. The arrowhead of claim 9 wherein at least a portion of the forward blade end is interfit with the body:

a. within the tip slot such that the forward blade end is restrained against displacement in directions oriented circumferentially about the forward blade end; and b. within the socket such that the forward blade end is restrained against displacement away from the forward blade end:

(1) in a direction radially away from the lengthwise axis of the body; and (2) in a direction toward the tip end along the length of the body.

11. An arrowhead including:

a. a blade extending between opposing forward and rear blade ends, b. an elongated body including (1) a forward body portion extending rearwardly from a tip end to a rear end, wherein the forward blade end is interfit with the forward body portion such that it is restrained against displacement away from the body:

(a) in a direction radially away from the lengthwise axis of the body, and (b) in a direction toward the tip end along the length of the body;

(2) a rearward body portion including:

(a) a first section extending rearwardly from the rear end of the forward body portion, wherein the first section has lesser outer diameter than the rear end of the forward body portion;

(b) a second section extending rearwardly from the first section of the rearward body portion, wherein the second section has lesser outer diameter than the first section of the rearward body portion;

(c) a blade pocket defined in the first and second sections, wherein the rear blade end rests within the blade pocket;

c. a retaining member closely fit over at least a portion of the second section of the rearward body portion, the retaining member being fit over the blade pocket and the rear blade end therein;

d. an arrow shaft fit over (1) the rearward body portion, and (2) the retaining member.

12. The arrowhead of claim 11 wherein the retaining member includes:

a. a stop protruding outwardly from the second section of the rearward body portion, and b. a spring extending between the stop and the first section of the rearward body portion.

13. The arrowhead of claim 11 wherein the tip end of the forward body portion includes:

a. a tip slot extending in a direction along the length of the body; and b. a socket adjacent the tip slot, the socket extending forwardly in a direction along the length of the body such that the socket defines a space between the tip end and a portion of the forward body portion extending rearwardly from the tip end.

14. The arrowhead of claim 13 wherein at least a portion of the forward blade end is interfit with the body:

a. within the tip slot such that the forward blade end is restrained against displacement in directions oriented circumferentially about the forward blade end, and b. within the socket such that the forward blade end is restrained against displacement away from the forward blade end:

(1) in a direction radially away from the lengthwise axis of the body, and (2) in a direction toward the tip end along the length of the body.

15. An arrowhead including:

a. a blade extending between opposing forward and rear blade ends, b. an elongated body including (1) a forward body portion extending rearwardly from a tip end to a rear end, wherein:

(a) the forward blade end is interfit with the forward body portion such that it is restrained against displacement away from the body:

(i) in a direction radially away from the lengthwise axis of the body, and (ii) a direction toward the tip end along the length of the body;

(b) the tip end of the forward body portion includes:

(i) a tip slot extending in a direction along the length of the body, (ii) a socket situated radially closer to the lengthwise axis of the body than the tip slot, the socket extending in a direction along the length of the body; and (c) at least a portion of the forward blade end is interfit with the body within the tip slot and the socket;

(2) a rearward body portion including:

(a) a first section extending rearwardly from the rear end of the forward body portion, wherein the first section has lesser outer diameter than the rear end of the forward body portion;

(b) a second section extending rearwardly from the first section of the rearward body portion, wherein the second section has lesser outer diameter than the first section of the rearward body portion;

(c) a blade pocket defined in the first and second sections, wherein:

(i) the rear blade end rests within the blade pocket; and (ii) both the tip slot and socket are situated forwardly from the blade pocket;

c. a retaining member closely fit over at least a portion of the second section of the rearward body portion, the retaining member being fit over the blade pocket and the rear blade end therein.

16. The arrowhead of claim 15 further including an arrow shaft fit over:

a. the rearward body portion; and b. the retaining member.

17. The arrowhead of claim 15 wherein the rearward body portion further includes a third section:

a. extending rearwardly from the second section of the rearward body portion; and b. bearing threading thereon.

c. having an outer diameter less than or equal to the outer diameter of the second section of the rearward body portion.

18. An arrowhead including:

a. a blade extending between opposing forward and rear blade ends, b. an elongated body including (1) a forward body portion extending rearwardly from a tip end to a rear end, wherein:

(a) the forward blade end is interfit with the forward body portion such that it is restrained against displacement away from the body:

(i) in a direction radially away from the lengthwise axis of the body, and (ii) in a direction toward the tip end along the length of the body;

(b) the tip end of the forward body portion includes:

(i) a tip slot extending in a direction along the length of the body, (ii) a socket adjacent the tip slot, the socket extending forwardly in a direction along the length of the body such that the socket defines a space between the tip end and a portion of the forward body portion extending rearwardly from the tip end;

(c) at least a portion of the forward blade end is interfit with the body:

(i) within the tip slot such that the forward blade end is restrained against displacement in directions oriented circumferentially about the forward blade end, and (ii) within the socket such that the forward blade end is restrained against displacement away from the body:

1) in a direction radially away from the lengthwise axis of the body, and 2) in a direction toward the tip end along the length of the body;

(2) a rearward body portion including:

(a) a first section extending rearwardly from the rear end of the forward body portion, wherein the first section has lesser outer diameter than the rear end of the forward body portion;

(b) a second section extending rearwardly from the first section of the rearward body portion, wherein the second section has lesser outer diameter than the first section of the rearward body portion;

(c) a blade pocket defined in the first and second sections, wherein the rear blade end rests within the blade pocket;

c. a retaining member closely fit over at least a portion of the second section of the rearward body portion, the retaining member being fit over the blade pocket and the rear blade end therein.

19. The arrowhead of claim 18 wherein retaining member includes a spring biased forwardly toward the forward body portion.

20. The arrowhead of claim 19 further including a washer having an inner diameter:

a. sized to receive the spring therein; and b. closely fit over at least a portion of the first section of the rearward body portion.

21. The arrowhead of claim 20:

a. further including a stop protruding from the rearward body portion rearwardly of the spring; and b. wherein the inner diameter of the washer is sized to fit about an outer diameter of the stop.

22. An arrowhead including:

a. a blade extending between opposing forward and rear blade ends, b. an elongated body including (1) a forward body portion extending rearwardly from a tip end to a rear end, wherein the forward blade end is mounted to the forward body portion;

(2) a rearward body portion having a blade pocket defined therein, wherein the rear blade end rests within the blade pocket;

c. a retaining member closely fit over at least a portion of the rearward body portion, the retaining member being fit over the blade pocket and the rear blade end therein;

d. an arrow shaft:

(1) fit over the retaining member, with the retaining member being situated between the arrow shaft and the rearward body portion in a radial direction extending from the longitudinal axis of the body; and (2) being engaged to the rearward body portion.

23. The arrowhead of claim 22 wherein the rearward body portion includes:

a. a first section extending rearwardly from the rear end of the forward body portion, wherein the first section has lesser outer diameter than the rear end of the forward body portion;

b. a second section extending rearwardly from the first section of the rearward body portion, wherein the second section has lesser outer diameter than the first section of the rearward body portion;

wherein the retaining member is closely fit over the second section of the rearward body portion.

24. The arrowhead of claim 23 wherein the retaining member includes:

a. a stop protruding outwardly from the second section of the rearward body portion, and b. a spring extending between the stop and the first section of the rearward body portion.

25. The arrowhead of claim 22 wherein the retaining member includes a spring biased forwardly toward the forward body portion.

26. The arrowhead of claim 22 further including a washer closely fit over the rearward body portion forwardly of the retaining member, the washer having a washer inner diameter:

a. fit over the blade pocket and the rear blade end therein, and b. sized to fit over the retaining member.

27. The arrowhead of claim 22 wherein the retaining member includes a spring biased forwardly toward the forward body portion.

28. An arrowhead including:

a. a blade extending between opposing forward and rear blade ends, b. an elongated body including (1) a forward body portion extending rearwardly from a tip end toward a rear end, wherein the forward blade end is mounted to the forward body portion;

(2) a rearward body portion extending rearwardly from the rear end of the forward body portion, wherein the rearward body portion has:

(a) a lesser outer diameter than the rear end of the forward body portion;

(b) a blade pocket defined therein, wherein the rear blade end rests within the blade pocket;

c. a washer closely fit over the rearward body portion adjacent the rear end of the forward body portion, the washer being fit over the blade pocket and the rear blade end therein;

d. a spring closely fit over the rearward body portion rearwardly of the washer, the spring being fit over the blade pocket and the rear blade end therein.

29. The arrowhead of claim 28 further including an arrow shaft:

a. affixed to the rearward body portion, b. fit over the spring, and c. in abutment with the washer.

30. The arrowhead of claim 28 wherein the washer has an inner diameter sized to fit about an outer diameter of the spring.

31. The arrowhead of claim 28 wherein the rearward body portion includes:

a. a first section extending rearwardly from the rear end of the forward body portion, and b. a second section extending rearwardly from the first section of the rearward body portion, wherein:

(1) the second section has lesser outer diameter than the first section of the rearward body portion, and (2) the spring is fit over the second section.

32. The arrowhead of claim 28:

a. further including a stop protruding from the rearward body portion rearwardly of the spring, and b. wherein the washer has an inner diameter sized to fit about an outer diameter of the stop.

33. An arrowhead including:

a. a blade extending between opposing forward and rear blade ends, b. an elongated body including (1) a forward body portion having the forward blade end thereon, the forward body portion extending from a tip end rearwardly to a rear end;

(2) a rearward body portion having:

(a) a first section extending rearwardly from the rear end of the forward body portion, (b) a second section extending rearwardly from the first section of the rearward body portion, and (c) a blade pocket defined within the rearward body portion, wherein the rear blade end rests within the blade pocket;

c. a stop protruding from the second section of the rearward body portion, d. a spring having:

(1) a forward spring end situated adjacent the first section of the rearward body portion, and (2) a rearward spring end abutting the stop, wherein the spring is fit over the blade pocket and the rear blade end therein.

34. The arrowhead of claim 33 wherein the stop, spring, and first section of the rearward body portion have outer diameters which are at least substantially equivalent.

35. The arrowhead of claim 33 further including a washer having an inner diameter:

a. sized to receive the stop and spring therein, and b. closely fit over at least a portion of the first section of the rearward body portion.

36. The arrowhead of claim 33 further including an arrow shaft:

a. connected to the rearward body portion, and b. fit over the stop and spring.

* * * * *